United States Patent [19]

Takagi et al.

[11] Patent Number: 4,986,525

[45] Date of Patent: Jan. 22, 1991

[54] SHEET FEED DEVICE FOR USE IN A PRINTER OR THE LIKE

[75] Inventors: Kazuhiko Takagi, Nagoya; Rikuo Sonoda, Nishikasugai; Kazuo Umemura, Nagoya, all of Japan

[73] Assignee: Brother Kogyo Kabushiki Kaisha, Japan

[21] Appl. No.: 468,204

[22] Filed: Jan. 22, 1990

[30] Foreign Application Priority Data

Jan. 25, 1989 [JP] Japan ..... 1-15287
Feb. 3, 1989 [JP] Japan ..... 1-26401

[51] Int. Cl.[5] ..... B65H 3/06

[52] U.S. Cl. ..... 271/114; 271/10; 271/4; 271/272; 400/625; 400/629; 400/636; 400/637

[58] Field of Search ..... 271/114, 113, 10, 4, 271/3, 272, 264; 400/624, 625, 629, 636, 637

[56] References Cited

U.S. PATENT DOCUMENTS 4,789,259 12/1988 Katayanagi ..... 400/625 X

FOREIGN PATENT DOCUMENTS 197262 8/1989 Japan ..... 271/10

*Primary Examiner*—David H. Bollinger
*Attorney, Agent, or Firm*—Oliff & Berridge

[57] ABSTRACT

A sheet feed device for feeding a sheet-like material includes a feed roller disposed upstream with respect to a sheet feeding direction for feeding the sheet-like material and main and auxiliary roller pair disposed downstream with respect thereto for further feeding the sheet-like material fed out by the feed roller. At the start of feeding the sheet-like material, both the feed roller and the main and auxiliary roller pair are rotated, and after the sheet-like material is fed a certain distance and grasped by the main and auxiliary roller pair, only the main and auxiliary roller pair is rotated, whereby a load imposed to a motor for rotating both the feed roller and main and auxiliary roller pair is lessened. According to another aspect of the invention, the sheet-like material is frictionally fed by the main and auxiliary roller pair, but in case where the peripheral speed of the auxiliary roller becomes slower than that of the main roller due to slippage caused by the sheet-like material interposed therebetween, the auxiliary roller is forcibly rotated at the peripheral speed substantially equal to that of the main roller, whereby the sheet-like material is prevented from being curved, jammed or wrinkled during the sheet feeding process.

16 Claims, 8 Drawing Sheets

SHEET FEED DEVICE FOR USE IN A PRINTER OR THE LIKE

BACKGROUND OF THE INVENTION

The present invention relates to a sheet feed device for use in a printer or the like.

Heretofore, a sheet feed device for use in a printer includes a peeling roller disposed in the upper portion of a hopper in which cut sheets are stacked. The peeling roller is in frictional contact with the uppermost sheet and feeds out the latter from the hopper toward a printing mechanism of the printer. However, when it is intended to print on a number of overlapping sheets, such as no-carbon sheets, at a time, the sheets are not smoothly fed only by the peeling roller, because the upper and lower sheets tend to be displaced from each other and the sheets tend to be curved before their leading edges reach the printing mechanism. When a short-length sheet of paper, such as a postcard, is fed by the sheet feed device, the sheet is released from the peeling roller before the leading edge thereof reaches the printing mechanism. The provision of only the peeling roller is insufficient to smoothly and perfectly feed various kinds of sheets.

To avoid the above shortcoming, it has been proposed to interpose main and auxiliary feed rollers between the peeling roller and the printing mechanism. The main feed roller is forcibly rotated by a drive source, such as a motor, and the auxiliary feed roller is rotatable in compliance with the rotation of the main feed roller. More specifically, these rollers are in frictional contact with each other so that the auxiliary feed roller is rotated in accordance with the rotation of the main feed roller with a sheet of paper being gripped therebetween. Alternatively, the main and auxiliary feed rollers are provided with intermeshing gears coupled to the ends of the rollers and the motor forcibly rotates the rollers simultaneously through the gears.

In the sheet feed device having the main and auxiliary feed rollers thus arranged, the auxiliary feed roller prevents the sheet from being curved when a long-length sheet is fed. When a short-length sheet is fed, it is prevented from being released from the auxiliary feed roller before it reaches the printing mechanism. The thus arranged sheet feed device rotates the rollers at all times irrespective of the length of the sheet to be fed, thereby feeding the sheet to the printing mechanism.

However, the following shortcomings are still outstanding in the proposed sheet feed device. Firstly, both the peeling roller located in an upstream position and the main and auxiliary feed rollers in the downstream position are driven by a single motor, so that the motor undergoes a large load and has a short service life. Secondly, when only one thin sheet of paper is to be fed, the auxiliary feed roller is substantially accurately rotated by the main feed roller; however, in the case where the auxiliary feed roller is rotated through the frictional contact with the main feed roller, when a number of overlapping sheets are to be fed, the rotation of the auxiliary feed roller is largely delayed with respect to the rotation of the main feed roller due to slippage between the sheets. A speed difference is developed between upper and lower sheets, and these sheets tend to be fed in different directions. As a result, the sheets being fed may be jammed or wrinkled. Thirdly, in the case where the main and auxiliary rollers are coupled through the intermeshing gears, a number of overlapping sheets can substantially accurately be fed as there is no substantial speed difference between the rollers; however, since it is highly difficult to fabricate the rollers such that their outer circumferential surfaces are in exact agreement with the pitch circles of the gears, the peripheral speed of one of the forcibly rotated rollers is liable to be higher or lower than the peripheral speed of the other roller. Fourthly, when the rollers are rotated in direct contact with each other without any sheets gripped therebetween, the motor is subjected to a very large load because the outer circumferential surfaces of the rollers have to slip forcibly against each other. Therefore, the motor must produce a large output power. Even if the motor is powerful enough to rotate the rollers, the outer circumferential surfaces of the rollers may get peeled off. This drawback holds true for an application in which a material that is less slippery with respect to the rollers is fed by the rollers.

SUMMARY OF THE INVENTION

The present invention has been made to obviate the aforementioned drawbacks. One aspect of the present invention has been made in view of the fact that a large load is applied to the motor when it drives the peeling roller.

It is an object of the present invention to provide a sheet feed device which can smoothly and perfectly feed sheets irrespective of kinds of sheets to be fed.

Another object of the present invention is to provide a sheet feed device in which the sheets are prevented from being curved, jammed and wrinkled.

Still another object of the present invention is to provide a sheet feed device in which the load imposed on a motor is reduced by selectively driving a peeling roller disposed in upstream position and a pair of main and auxiliary feed rollers disposed in downstream position and in which the service life of the motor is prolonged.

In order to achieve the above and other objects, according to one aspect of the present invention, there is provided a sheet feed device for feeding a sheet-like material in a sheet feeding direction comprising first roller means rotatably disposed upstream with respect to the sheet feeding direction for feeding the sheet-like material in the sheet feeding direction, second roller means rotatably disposed downstream of the first roller means with respect to the sheet feeding direction for further feeding the sheet-like material fed by the first roller means in the sheet feeding direction, a reversible motor having a motor shaft for producing a rotating power, the motor being selectively rotatable in a first direction and a second direction opposite the first direction, and a power transmitting mechanism operatively coupled to the first and second roller means for transmitting the rotating power of the motor to both the first and second roller means when the motor is rotated in the first direction and for transmitting the rotating power of the motor to only the second roller means when the motor is rotated in the second direction.

When the motor is rotated in the first direction, the rotating power of the motor is transmitted to both the first and second roller means by the power transmitting mechanism to thereby feed out and deliver the sheet-like material in the sheet feeding direction. When the motor is reversely rotated, i.e., in the second direction, the rotating power of the motor is transmitted to only the second roller means by the power transmitting mechanism to thereby further deliver the sheet-like material in the sheet feeding direction.

With the sheet feed device thus arranged, the sheet-like material being fed is prevented from being curved, jammed and wrinkled, and can smoothly be fed irrespective of whether it is long or short. Further, since the first roller means is driven only when it is necessary, the load imposed on the motor can be lessened.

According to another aspect of the present invention, there is provided a sheet feed device for feeding a sheet-like material in a sheet feeding direction comprising a main feed roller rotatable about its own axis extending in a direction to transverse the sheet-like material to be fed, an auxiliary feed roller rotatable about its own axis extending in parallel to the axis of the main feed roller, the main and auxiliary feed rollers cooperating with each other to frictionally feed the sheet-like material in the sheet feeding direction, a motor for rotating the main feed roller at a given rotational speed, and a clutch mechanism for transmitting the rotation of the main feed roller to the auxiliary feed roller when the auxiliary feed roller rotates at a rotational speed slower than a predetermined speed and for cutting the transmission of the rotation of the main feed roller to the auxiliary feed roller when the auxiliary feed roller rotates at a rotational speed faster than the predetermined speed.

With the above arrangement, the sheet-like material is gripped between the main feed roller and the auxiliary feed roller and frictionally fed by the rollers. When the auxiliary feed roller is substantially accurately rotated in compliance with the rotation of the main feed roller, the clutch mechanism cuts off the power transmitted from the main feed roller to the auxiliary feed roller which is thus not forcibly rotated. Conversely, when the auxiliary feed roller is rotated at a peripheral speed much lower than the peripheral speed of the main feed roller on account of slippage between the sheet-like material and the rollers, the auxiliary feed roller is forcibly rotated to thereby equalize the peripheral speed of the auxiliary feed roller to the peripheral speed of the main feed roller.

When there is a loss of power to be transmitted from the main feed roller to the auxiliary feed roller due to the presence of the sheet-like material therebetween, the auxiliary feed roller is rotated substantially the same speed as the main feed roller. The clutch mechanism forcibly rotates the auxiliary feed roller. Consequently, the sheet-like material to be fed can smoothly be fed without jam.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

The expressions "front", "rear", "above" and "below" are used throughout the description to define the various parts when the printer is disposed in an orientation in which it is intended to be used.

Figure 1A:
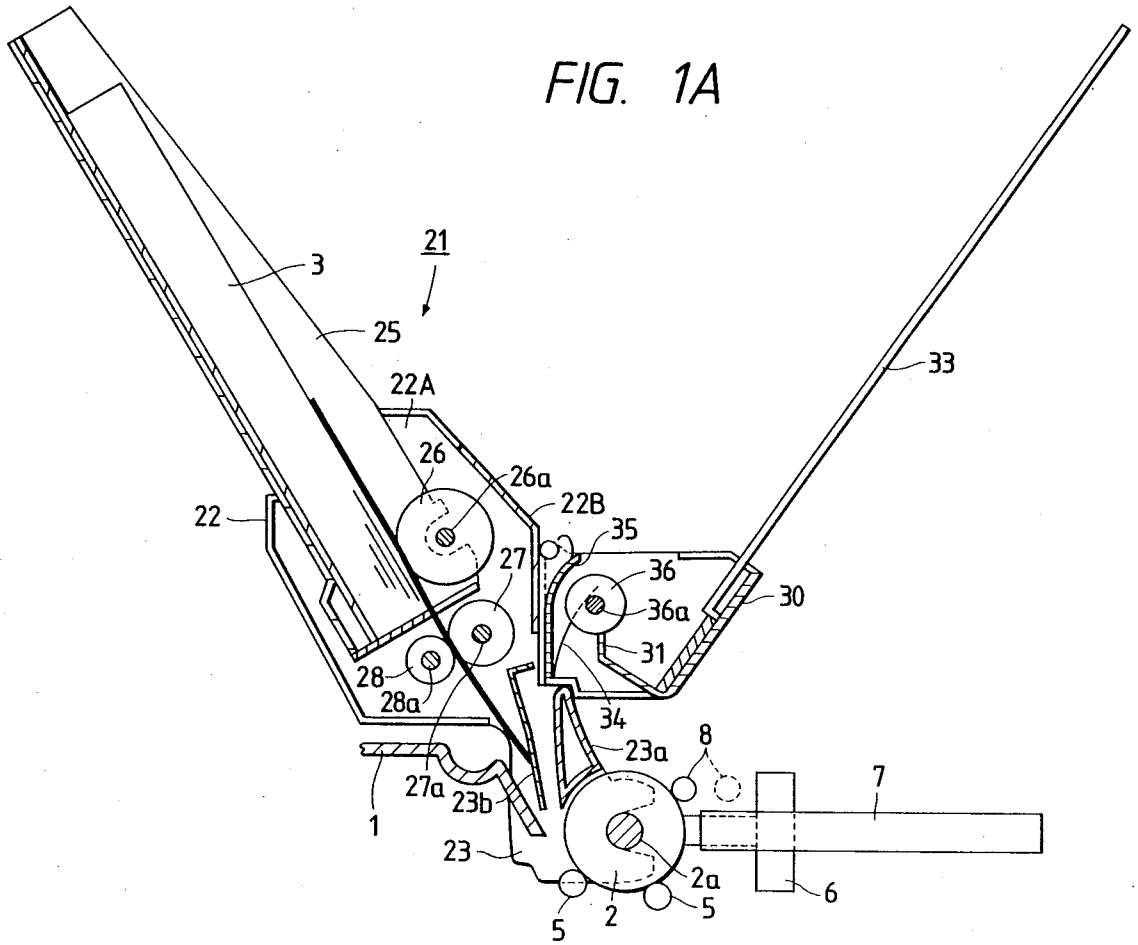
FIG. 1A is a cross-sectional side elevational view showing a printer to which the present invention is applied.

As shown in FIG. 1A, a platen 2 is rotatably supported in a printer frame 1 (only partly shown), and a plurality of sheet presser rollers 5 (two rollers being shown in FIG. 1A) are disposed around and held against the platen 2, the sheet presser rollers 5 being rotatable in compliance with the rotation of the platen 2. A paper bail 8 movable toward and away from the platen 2 is also disposed against the platen 2. A print head 6 is mounted on a carriage (not shown) movable along the platen 2. A ribbon cassette 7 housing a print ribbon is detachably mounted on the carriage and is moved along the platen 2.

A sheet supply/receiving device 21 is removably disposed above the platen 2. The sheet supply/receiving device 21 has a frame 22 comprising a pair of side frame members 22A and a front wall panel 22B extending between and supported by the side frame members 22A. The side frame members 22A have a pair of respective connector arms 23 (one being shown) engageable with the opposite ends of a shaft 2*a* of the platen 2. A pair of sheet guides 23*a*, 23*b* that are spaced from each other is disposed between and supported by the connector arms 23.

A hopper 25 for storing a stack of cut sheets 3 is mounted on the frame 22, the hopper 25 being inclined such that its upper surface is slanted rearwardly of the printer. A peeling roller 26 for peeling the uppermost sheet 3 from the other sheets in the hopper 25 and feeding the sheet 3 toward the platen 2 is rotatably supported on the frame 22. A main feed roller 27 and an auxiliary feed roller 28 are also rotatably supported through respective shafts 27*a*, 28*a* thereof on the frame 22. The main feed roller 27 and the auxiliary feed roller 28 are held against each other, and a sheet 3 is fed between the rollers 27, 28.

A stacker 30 is mounted on the frame 22. The stacker 30 is in the form of a box which has upper and lower open sides and is slender in a direction parallel to the platen 2. The stacker 30 includes a support 31 disposed in a front lower portion thereof for supporting the lower end of a sheet 3 which is discharged from the platen 2. A support member 33 for supporting an upper portion of a printed sheet 3 with its printed face up projects from the support 31, the support member 33 having an upper end inclined forwardly of the printer. The stacker 30 has a rear wall serving as a guide wall 35. A feed roller 36 for delivering sheet 3 fed from the platen 2 toward the support member 33 is disposed inwardly of the guide wall 35, and rotatably supported through its shaft 36*a*. A flexible film 34 for pressing a sheet 3 against the feed roller 36 is also disposed inwardly of the guide wall 35.

A drive mechanism for driving the above rollers will be described below.

Figure 2A:
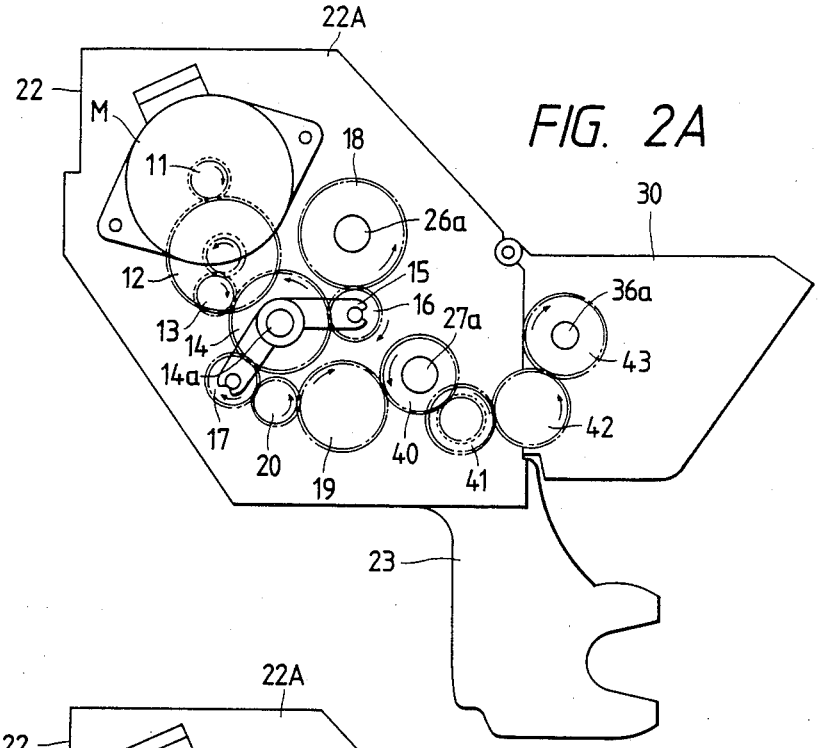
FIGS. 2A and 2B are side elevational views each showing a drive mechanism according to one embodiment of the present invention.
Figure 3:
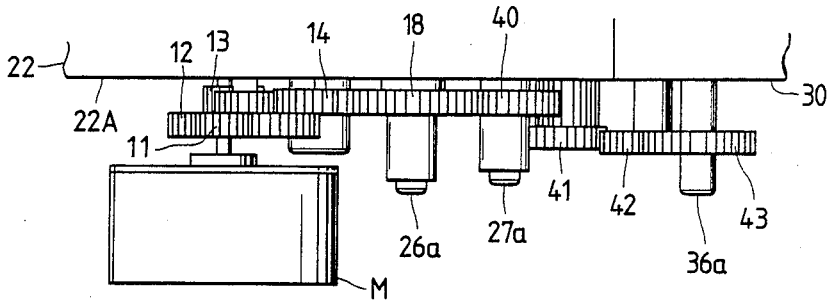
FIG. 3 is a plan view showing the drive mechanism shown in FIGS. 2A and 2B.

As shown in FIGS. 2A and 3, a peeling gear 18, a main feed gear 40 and a feed gear 43 are co-rotatably mounted on the shafts 26*a*, 27*a*, 36*a* of the peeling roller 26, the main feed roller 27, and the feed roller 36, respectively. Those gears 18, 40, 43 are provided on the outer side of the side frame member 22A of the frame 22. A drive motor M energizable by electric pulses is disposed on the outer surface of the side frame member 22A. The drive motor M has a motor shaft which supports a motor gear 11 held in mesh with a large-diameter gear of a speed-reduction gear assembly 12 composed of two gears of different radii. A power transmitting gear 14 is rotatably supported on the side frame member 22A near the speed-reduction gear assembly 12. Rotation of the speed-reduction gear assembly 12 is transmitted from the smaller-diameter gear thereof through an idler gear 13 to the power transmitting gear 14.

The power transmitting gear 14 has an integral central shaft 14*a* on which a swing arm 15 is swingably mounted at its intermediate portion. The swing arm 15 is frictionally coupled to the central shaft 14*a* so that the swing arm 15 can swing with the central shaft 14*a*, but the central shaft slips with respect to the swing arm 15 when the latter is stopped. Main and auxiliary swing gears 16, 17 are rotatably mounted on the opposite ends, respectively, of the swing arm 15, and are held in mesh with the power transmitting gear 14.

Between the auxiliary swing gear 17 and the main feed gear 40, there are rotatably supported a pair of larger- and smaller-diameter idler gears 19, 20 for transmitting rotation of the auxiliary swing gear 17 to the main feed gear 40.

Figure 2B:
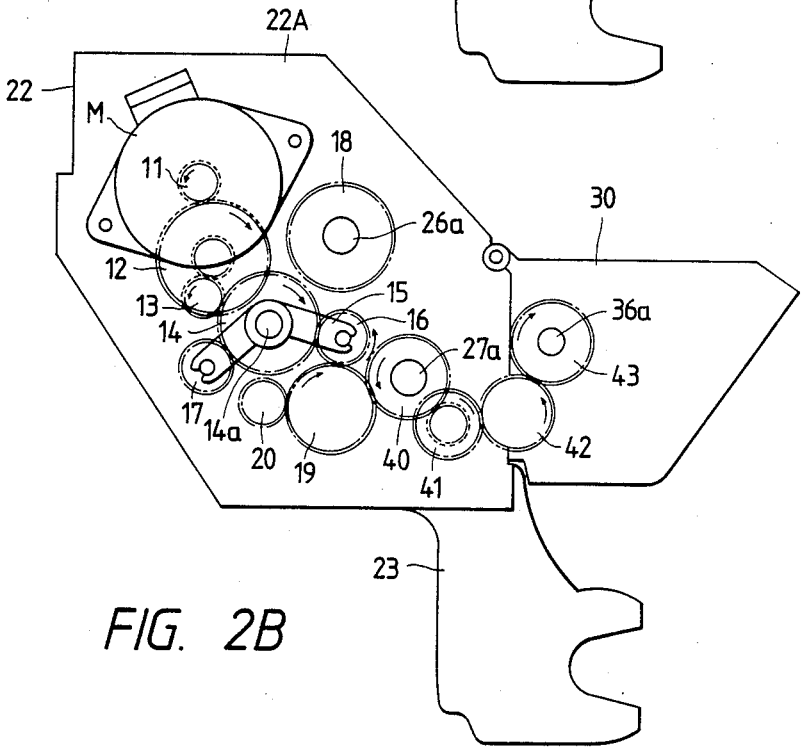

As shown in FIGS. 2A and 2B, the main swing gear 16 is in alternative mesh with the peeling gear 18 or the larger-diameter idler gear 19 depending on swinging movement of the swing arm 15. The auxiliary swing gear 17 is selectively brought into and out of mesh with the smaller-diameter idler gear 20 depending on swinging movement of the swing arm 15. When the main swing gear 16 meshes with the peeling gear 18, the auxiliary swing gear 17 meshes with the idler gear 20. When the main swing gear 16 is in mesh with the idler gear 19, the auxiliary swing gear 17 is kept out of mesh with the idler gear 20. Therefore, the idler gear 19 is always kept in driven relation to the power transmitting gear 14 through either the main swing gear 16 or the auxiliary swing gear 17 and the idler gear 20.

Between the main feed gear 40 and the feed gear 43, there are disposed an idler gear 41 rotatably supported on the side frame member 22A and meshing with the main feed gear 40, and an idler gear 42 rotatably supported on an outer frame of the stacker 30 and meshing with the feed gear 43, the idler gear 41, 42 meshing with each other.

Operation and advantages of the sheet feed device for the printer, thus constructed, will be described below with reference to the timing chart of operation of the drive motor shown in FIG. 4.

With a stack of cut sheets 3 held in the hopper 25 as illustrated in FIG. 1A, the drive motor M is rotated in a forward direction through an angular interval corresponding to 30 pulses at the rate of 100 pulses per second (pps), and then rotated in the forward direction through an angular interval corresponding to 390 pulses at the rate of 270 pps. Upon such rotation, the motor gear 11 is rotated in a forward direction (i.e., in the direction indicated by the arrow in FIG. 2A), causing the speed-reduction gear assembly 12 and the idler gear 13 to rotate the power transmitting gear 14 counterclockwise. The central shaft 14*a* of the power transmitting gear 14 is rotated to angularly move the swing arm 15 in the same direction through frictional contact therewith. Therefore, the peeling roller 26 is rotated to peel the uppermost sheet from the stack of sheets 3 in the hopper 25 and delivers the separated sheet 3 between the main and auxiliary feed rollers 27, 28.

The counterclockwise rotation of the swing arm 15 brings the auxiliary swing gear 17 into mesh with the idler gear 20. Thus, rotation of the auxiliary swing gear 17 is transmitted through the idler gears 20, 19 to the main feed gear 40, which rotates the main feed roller 27 in a direction to feed the sheet 3. The main feed roller 27 and the auxiliary feed roller 28 which rotates in compliance with the main feed roller 27 cooperate with each other in sending the sheet 3 a predetermined interval along the sheet guide 23*b* while the sheet 3 is being gripped by the main and auxiliary feed rollers 27, 28. At this time, as shown in FIG. 1A, the leading end of the sheet 3 is positioned upwardly of the sheet presser rollers 5.

Figure 1B:
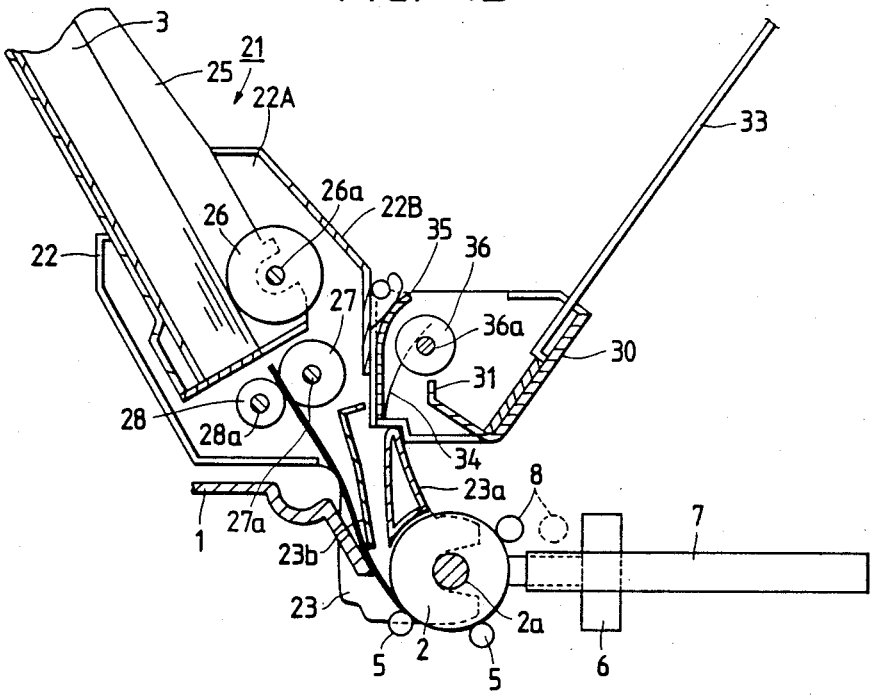
FIGS. 1B through 1D are cross-sectional side elevational views illustrative of the positions of a sheet when it is fed.
Figure 4:
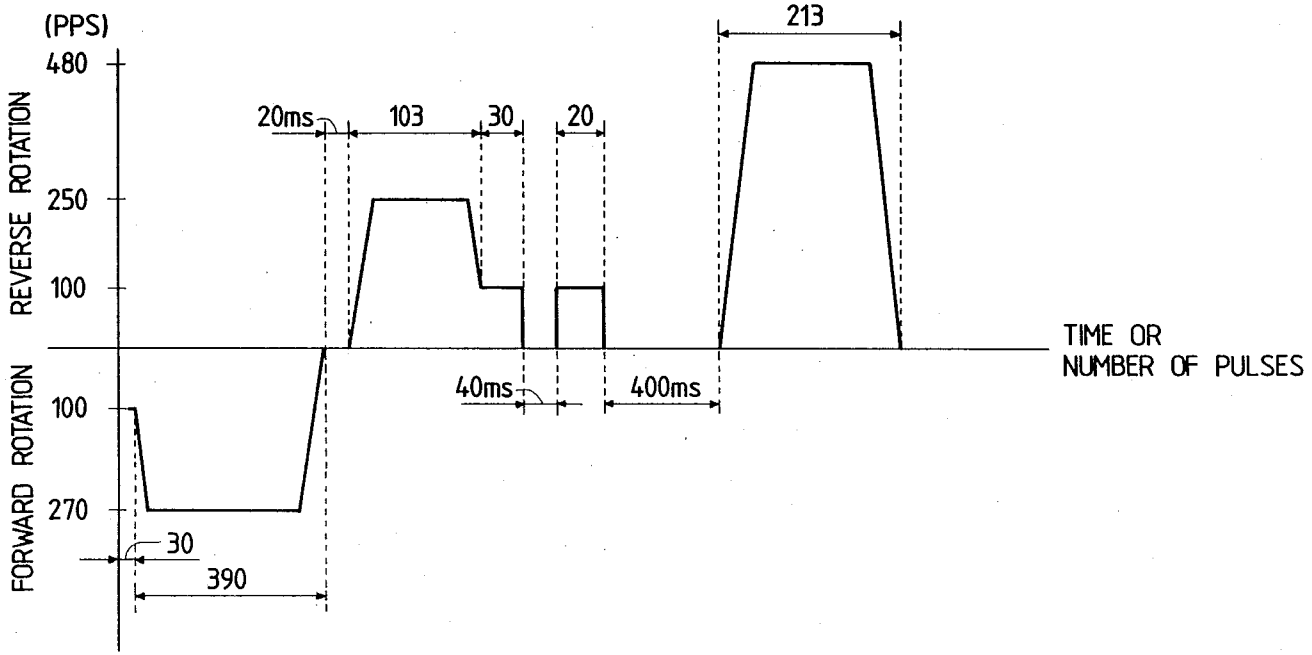
FIG. 4 is a timing chart for description of operation of a drive motor used in conjunction with the drive mechanism shown in FIGS. 2A and 2B.

Then, the drive motor M remains de-energized for 20 milliseconds (ms) as shown in FIG. 4, and thereafter is reversed (in the direction indicated by the arrow in FIG. 2B) through an angular interval corresponding to 103 pulses at the rate of 250 pps. The rotation of the drive motor M is transmitted through the motor gear 11, the speed-reduction gear assembly 12, and the idler gear 13 to the power transmitting gear 14, thereby rotating the power transmitting gear 14 clockwise. The swing arm 15 is now turned clockwise to displace the main swing gear 16 out of mesh with the peeling gear 18 and also to displace the auxiliary swing gear 17 out of mesh with the idler gear 20. Only the main swing gear 16 is brought into mesh with the idler gear 19 to transmit the rotation to the idler gear 19, which is rotated clockwise in the same manner as shown in FIG. 2A. Therefore, after the sheet 3 has been gripped between the main and auxiliary feed rollers 27, 28, the peeling roller 26 released from the rotating power from the drive motor M, but the main and auxiliary feed rollers 27, 28 are continuously rotated by the power from the drive motor M for delivering the sheet 3 toward the platen 2 as shown in FIG. 1B. The drive motor M is continuously reversely rotated through an angular interval corresponding to 30 pulses at the rate of 100 pps until the leading end of the sheet 3 is positioned between the platen 2 and one of the sheet presser rollers 5 as shown in FIG. 1B.

Subsequently, the drive motor M is de-energized for 40 ms and then reversely moved again through an angular interval corresponding to 20 pulses at the rate of 100 pps. In synchronism with this reverse rotation of the drive motor M, the platen 2 which has remained freely rotatable so far is now rotated counterclockwise in FIG. 1A. Based on the reverse rotation of the drive motor M and the rotation of the platen 2, the leading end of the sheet 3 is positioned and gripped between the platen 2 and the sheet presser roller 5. Then, the drive motor M is de-energized for 400 ms until the paper bail 8 is spaced from the platen 2 by an actuator (not shown). During this time, the platen 2 remains stopped.

The platen 2 is then rotated counterclockwise and the drive motor M is reversely rotated through an angular interval corresponding to 213 pulses at the rate of 480 pps. The sheet 3 is fed to the position of the paper bail 8 by the platen 2 and the main and auxiliary feed rollers 27, 28, after which the paper bail 8 moves toward the platen 2 to grip the sheet 3 between the paper bail 8 and the platen 2. Through the above process, the sheet 3 is now set in the printer so as to be ready for being printed, and then the drive motor M is de-energized.

Figure 1C:
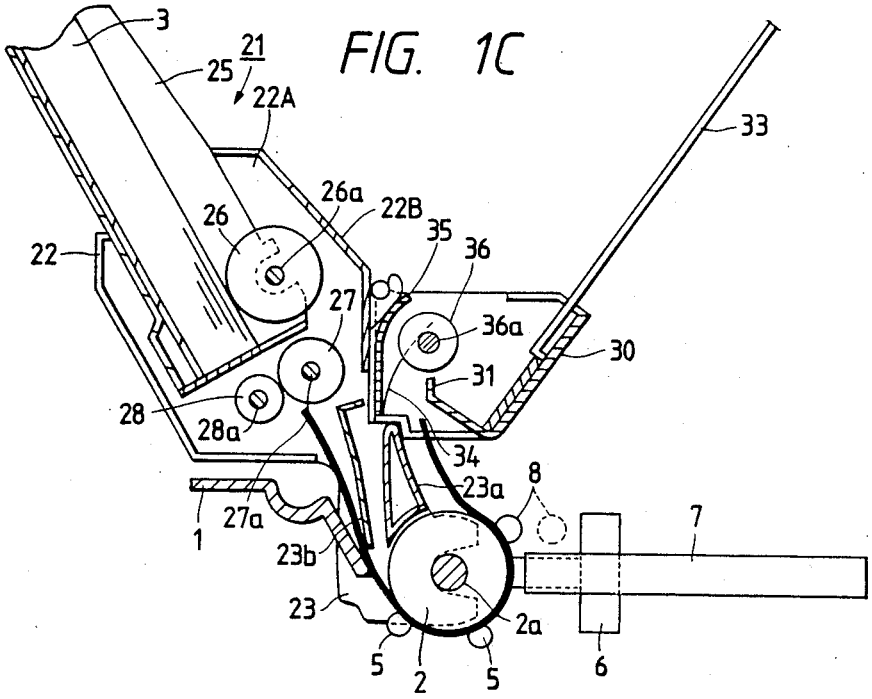
Figure 1D:
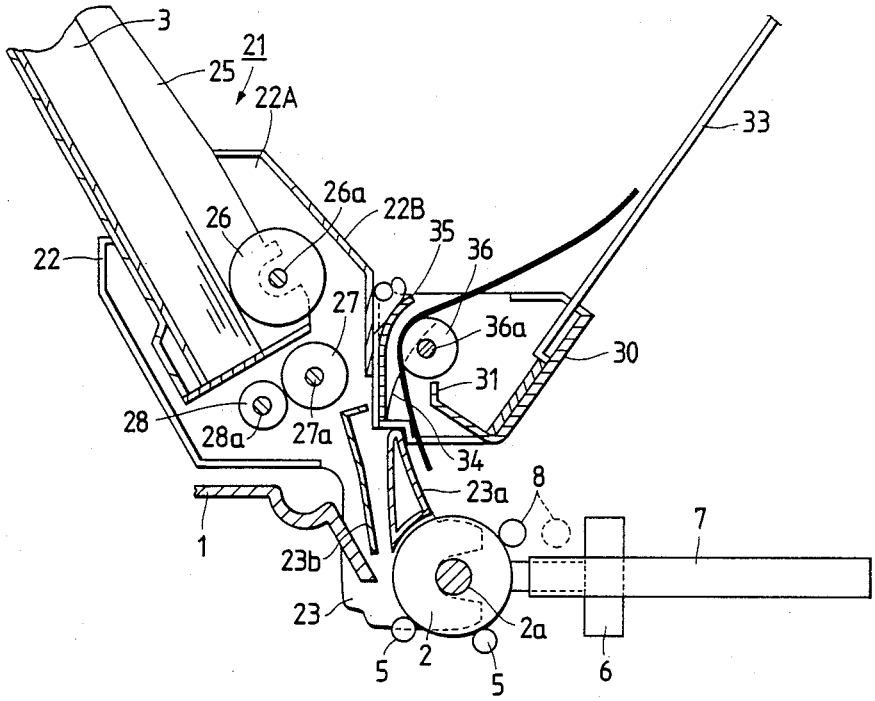

Thereafter, as shown in FIG. 1C, the sheet 3 is printed by the print head 6, and then delivered into the stacker 30 by the platen 2 which is rotated. The sheet 3 is introduced between the guide wall 35 and the support 31 into a position between the feed roller 36 and the flexible film 34. After the sheet 3 has been printed over one page, the leading end of the sheet 3 is gripped between the feed roller 36 and the flexible film 34, whereupon the drive motor M is reversely rotated. The main feed roller 40 is rotated to cause the idler gear 41, 42 and the feed gear 43 to rotate the feed roller 36 for thereby stacking the printed sheet 3 onto the support member 33 of the stacker 30.

With the sheet feed device for the printer according to the illustrated embodiment, the peeling roller 26 is driven to separate the uppermost sheet 3 from the reminder, and the leading end of the sheet 3 is inserted between the main and auxiliary feed rollers 27, 28. Thereafter, the drive motor M is reversely rotated to cut off the power transmitted to the peeling roller 26. Therefore, the load on the drive motor M can be reduced.

Figure 5:
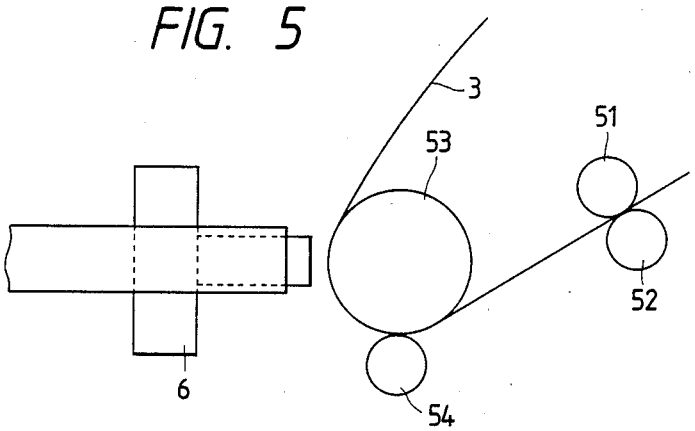
FIG. 5 is a schematic view showing a modification of the embodiment shown in FIGS. 2A and 2B.

The above-described embodiment may be modified as follows. While the drive motor M is mounted in the sheet supply/receiving device 21, it may be disposed in the printer, or the motor for rotating the platen 2 may double as the drive motor M. According to a further modification, as schematically shown in FIG. 5, a pair of feed rollers 51, 52 are disposed in a manual insertion slot positioned upstream of the platen 53. When the drive motor M is rotated in the forward direction, the rotating power thereof is transmitted to the feed rollers 51, 52, a platen 53, and a sheet presser roller 54 through the same transmitting mechanism as described in the above embodiment to rotate them in the sheet feeding direction. When the drive motor M is reversely rotated, only the platen 53 and the sheet presser roller 54 are rotated in the sheet feeding direction.

More specifically, when the leading end of the sheet 3 is inserted between the feed rollers 51 and the drive motor M is rotated in the forward direction, the sheet 3 is fed toward the platen 53 and then gripped between the platen 53 and the sheet presser roller 54. At the time the trailing end of the sheet 3 has just moved past the feed rollers 51, 52, the drive motor M is reversed. In this manner, even if next sheet 3 to be printed is located near the feed rollers 51, 52, such next sheet 3 will not be fed by the feed rollers 51, 52. Consequently, sheets are prevented from being fed in overlapping fashion. The load on the drive motor M is also reduced.

Another embodiment of a drive mechanism for driving the main and auxiliary feed rollers 27, 28 will next be described.

Figure 6:
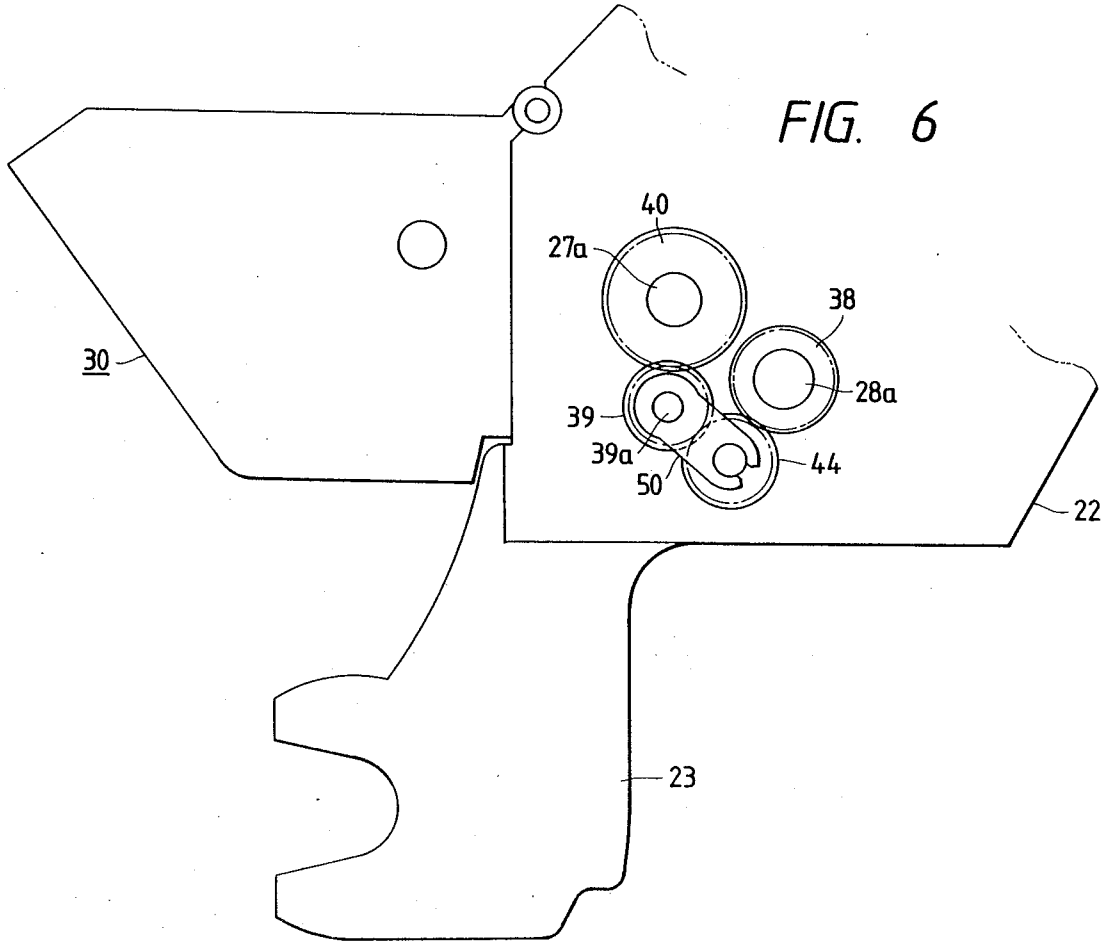
FIG. 6 is a fragmentary righthand side elevational view showing a sheet feed device according to another embodiment of the present invention.

As shown in FIG. 6, the main feed gear 40 and the auxiliary feed gear 38 are co-rotatably mounted on the shafts 27*a*, 28*a* of the feed rollers 27, 28 on the righthand side of the frame 22. The main feed gear 40 is held in mesh with a drive gear 39. The drive gear 39 has a projecting central shaft 39*a* on which an end of a swing lever 50 is swingably mounted. The swing lever 50 is frictionally coupled to the central shaft 39*a* so that the swing lever 50 can swing with the central shaft 39*a*, but the central shaft 39*a* can easily slip with respect to the swing lever 50 when the swing lever 50 is stopped.

A clutch gear 44 is rotatably mounted on the distal end of the swing lever 50 and meshes with the drive gear 39 at all times. The clutch gear 44 can also be brought into mesh with the auxiliary feed gear 38 in response to angular movement of the swing lever 50. The main feed gear 40, the auxiliary feed gear 38, the drive gear 39, the clutch gear 44, and the swing lever 50 jointly constitute a power transmitting means. The swing lever 50 and the clutch gear 44 jointly serve as a clutch mechanism.

The diameter and the number of teeth of the auxiliary feed gear 38 are selected such that when the auxiliary feed roller 28 is rotated by frictional contact between the main feed roller 27 and the auxiliary feed roller 28 at a peripheral speed ratio of substantially 1:1 with respect to the main feed roller 27, the peripheral speed of the auxiliary feed gear 38 rotating with the auxiliary feed roller 28 is higher than the peripheral speed of the auxiliary feed gear 38 which is rotated by the clutch gear 44 through the gear train 40, 38, 44.

Operation of the sheet feed device thus constructed will be described below.

When sheets 3 stacked in the hopper 25 are supplied one at a time to the platen 2, the peeling roller 26 is rotated by the motor as described previously, and the main feed roller 27 is also rotated in the direction to feed the sheets. The uppermost sheet 3 is peeled off by the peeling roller 26 and fed between the main feed roller 27 and the auxiliary feed roller 28. Then, the sheet 3 is gripped between the main feed roller 27 and the auxiliary feed roller 28. As the main and auxiliary feed rollers 27, 28 are rotated, the sheet 3 is delivered along the sheet guide 23*b* toward the platen 2. The sheet 3 is then printed by the print head 6, and thereafter introduced between the feed roller 36 and the flexible film 34. Upon rotation of the feed roller 36, the sheet 3 is placed on the support 31 and the support member 33 of the stacker 30.

If a single sheet 3 is inserted between the main and auxiliary feed rollers 27, 28 and there is no slippage between the rollers 27, 28 and the sheets, rotating power of the main feed roller 27 is reliably transmitted to the auxiliary feed roller 28 through the sheet 3, causing the auxiliary feed roller 28 to rotate in synchronism with the main feed roller 27. At this time, the peripheral speeds of the auxiliary and main feed rollers 28, 27 are of the ratio of 1:1, so that the sheet 3 is smoothly fed thereby.

Figure 7A:
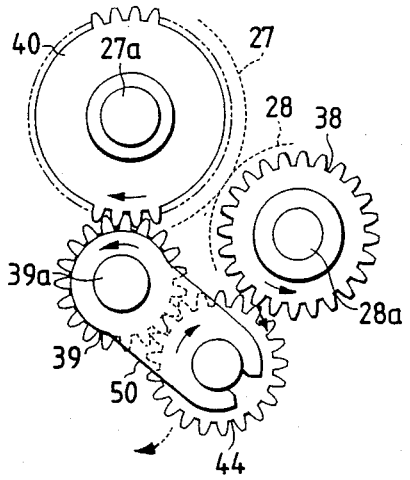
FIGS. 7A through 7C are plan views for description of the operation of the sheet feed device shown in FIG. 6.

Rotating power of the motor is also transmitted to the clutch gear 44 through the drive gear 39. Therefore, as shown in FIG. 7A, in response to rotation of the drive gear 39, the swing lever 50 is angularly moved in the same direction as the direction of rotation of the drive gear 39 through frictional contact between the swing lever 50 and the central shaft 39*a*, so that the clutch gear 44 on the distal end of the swing lever 50 moves toward the auxiliary feed gear 38. Since the peripheral speed of the auxiliary feed gear 38 rotated by the auxiliary feed roller 28 is higher than the peripheral speed of the auxiliary feed gear 38 to be rotated by the clutch gear 44, when the clutch gear 44 contacts the auxiliary feed gear 38, the teeth of the auxiliary feed gear 38 repel the teeth of the clutch gear 44, and hence the gears 38, 44 are kept out of mesh with each other. Therefore, the auxiliary feed roller 28 is rotated only by the rotating power transmitted from the main feed roller 27 through the sheet 3.

Figure 7B:
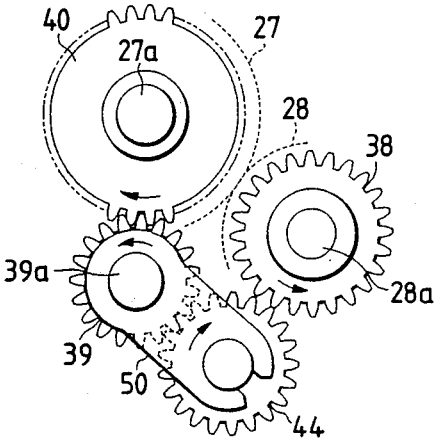

While the sheet 3 is being fed smoothly, the tips of the teeth of the clutch gear 44 and the auxiliary feed gear 38 abut against each other while these gears 38, 44 are being rotated as shown in FIGS. 7A or 7B.

Figure 7C:
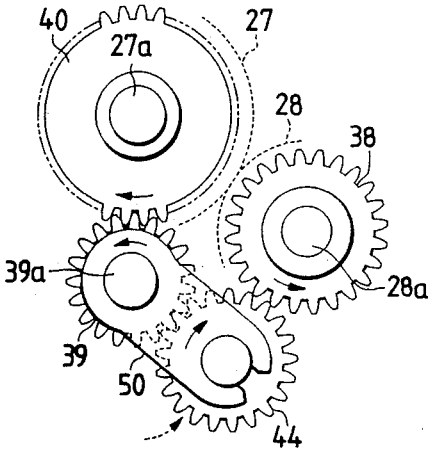

If a sheet 3 composed of a number of overlapping sheet layers joined at one side marginal edge is inserted between the main and auxiliary feed rollers 27, 28 and there is a loss of the rotating power transmitted therebetween due to slippage between the sheet layers, the rotating power of the main feed roller 27 is not sufficiently transmitted to the auxiliary feed roller 28, resulting in a reduction in the peripheral speed of the auxiliary feed roller 28. Then, as shown in FIG. 7C, upon rotation of the drive gear 39, the teeth of the clutch gear 44 are brought between the teeth of the auxiliary feed gear 38 by the swing lever 50, thereby causing the clutch gear 44 and the auxiliary feed gear 38 to mesh with each other.

Consequently, the rotating power of the drive gear 39 is transmitted to the auxiliary feed roller 28 through the clutch gear 44 and the auxiliary feed gear 38, so that the auxiliary feed roller 28 is forcibly rotated. The power loss due to the slippage between the sheet layers is thus eliminated, and the sheet 3 is fed smoothly. At this time, the peripheral speed ratio between the main feed roller 27 and the auxiliary feed roller 28 is selected to be about 1:0.95 in this embodiment. When the peripheral speed of the auxiliary feed roller 28 drops below the above speed ratio, therefore, the clutch gear 44 is brought into mesh with the auxiliary feed gear 38, and the peripheral speed ratio between the main and auxiliary feed rollers 27, 28 is maintained at the above ratio.

With the sheet feed device of this embodiment, if there is no loss of the rotating power transmitted between the main and auxiliary feed rollers 27, 28 through a sheet being fed, then the rotation of the main feed roller 27 can be reliably transmitted to the auxiliary feed roller 28 through the sheet 3. Even if there is a loss of the rotative power between the main feed roller 27, the auxiliary feed roller 28, and the sheet 3, the auxiliary feed roller 28 is forcibly rotated to keep its peripheral speed at a preset speed. When the sheet 3 being fed passes between the rollers 27, 28, therefore, the sheet 3 is fed smoothly without being wrinkled.

Although the present invention has been described with reference to specific embodiments, it should be understood that a variety of changes and modifications may be made without departing from the scope and spirit of the present invention. For example, the sheet feed devices according to the above-described two embodiments can be used together without need for substantial modification.

Specifically, the sheet feed device may comprise a power transmitting mechanism operatively coupled to the peeling roller 26 and the main feed roller 27 for transmitting the rotating power of the drive motor M to both the peeling roller 26 and the main feed roller 27 when the drive motor M is rotated in the forward direction and for transmitting the rotating power of the drive motor M to only the main feed roller 27 when the drive motor M is rotated reversely, and a clutch mechanism for transmitting the rotation of the main feed roller 27 to the auxiliary feed roller 28 when the auxiliary feed roller rotates at a rotational speed slower than a predetermined speed and for cutting the transmission of the rotation of the main feed roller 27 to the auxiliary feed roller 28 when the auxiliary feed roller 28 rotates at a rotational speed faster than the predetermined speed. With such arrangement of the sheet feed device, the load imposed on the drive motor M can be effectively lessened.

The sheet feed device according to the present invention may be applicable not only to feed a sheet of paper but also a sheet-like material. The sheet feed device of the present invention can be used not only in the printer but also in data recording apparatuses, such as a copying machine, which record data on the sheet-like material.

What is claimed is:

1. A sheet feed device for feeding a sheetlike material in a sheet feeding direction, comprising:

first roller means rotatably disposed upstream with respect to the sheet feeding direction for feeding the sheet-like material in the sheet feeding direction;

second roller means rotatably disposed downstream of said roller means with respect to the sheet feeding direction for further feeding the sheetlike material fed by said first rollers means in the sheet feeding direction;

a reversible motor having a motor shaft for producing a rotating power, said motor being selectively rotatable in a first direction and a second direction opposite the first direction; and a power transmitting mechanism operatively coupled to said reversible motor, and said first and second roller means for transmitting the rotating power of said motor to both said first and second rollers means when said motor is rotated in the first direction and for transmitting the rotating power of said motor to only said second roller means when said motor is rotated in the second direction;

further comprising stacker means for storing therein a plurality of sheet-like materials, and wherein said first roller means takes out one of the plurality of sheet-like materials out of said stacker means; and wherein said second roller means comprises a main feed roller rotatable about its own axis extending in a direction to transverse the sheet-like material to be fed, said main feed roller having a main feed roller gear secured to the axis of said main feed roller, and an auxiliary feed roller rotatable about its own axis extending in parallel to the axis of said main feed roller, said auxiliary feed roller having an auxiliary feed roller gear secured to the axis of said auxiliary feed roller, said main and auxiliary feed rollers cooperating with each other to frictionally feed the sheet-like material in the sheet feeding direction.

2. A sheet feed device according to claim 1, wherein said main feed roller is operatively coupled to said motor by said power transmitting mechanism, and said auxiliary feed roller is frictionally rotated as the sheet-like material is fed through said main and auxiliary feed rollers.

3. A sheet feed device according to claim 2, further comprising a clutch mechanism for transmitting the rotation of said main feed roller to said auxiliary feed roller when said auxiliary fed roller rotates at a rotational speed slower than a predetermined speed and for cutting the transmission of the rotation of said main feed roller to said auxiliary feed roller when said auxiliary feed roller rotates at a rotational speed faster than the predetermined speed.

4. A sheet feed device according to claim 3, wherein said clutch mechanism comprises a drive gear rotatable about its own axis, said drive gear being held in mesh with said main feed gear, a swing lever swingably mounted on the axis of said drive gear to be slippingly rotatable with the axis thereof, said swing lever having a distal end, and a clutch gear rotatably mounted on the distal end of said swing lever, said clutch gear being held in mesh with said drive gear and being adapted to be meshingly engageable with said auxiliary feed roller gear.

5. A sheet feed device according to claim 4, wherein said clutch gear is brought to meshing engagement with said auxiliary feed roller gear when said auxiliary feed roller is rotating at the rotational speed slower than a rotational speed of said clutch gear, and wherein said clutch gear is held in disengagement with said auxiliary feed roller gear when said auxiliary feed roller is rotating at the rotational speed faster than the rotational speed of said clutch gear.

6. A sheet feed device according to claim 1, further comprising a motor gear supported on the motor shaft of said motor, said motor shaft being rotated at a given rotational speed, and a speed-reduction gear assembly having a larger-diameter gear and a smaller-diameter gear for reducing the rotational speed of said motor shaft, the larger-diameter gear being held in mesh with said motor gear and the smaller-diameter gear being operatively coupled to said power transmitting mechanism.

7. A sheet feed device according to claim 6, wherein said power transmitting mechanism comprises:

a power transmitting gear rotatable about its own shaft, said power transmitting gear being operatively coupled to the smaller-diameter gear;

a swing arm having a first arm and a second arm, said swing arm being slippingly coupled to the shaft of said power transmitting gear to be swingable in accordance with the rotation of the shaft of said power transmitting gear;

a first swing gear rotatably mounted on the first arm, said first swing gear being held in mesh with said power transmitting gear; and a second swing gear rotatably mounted on the second arm, said second swing gear being held in mesh with said power transmitting gear, wherein said swing arm is movable between two positions depending on the rotational direction of said motor, one position being such that said first swing gear is operatively coupled to said first roller means and said second swing gear is operatively coupled to said second roller means when said motor is rotated in the first direction and the other position being such that said first swing gear is operatively coupled to said second roller means and said second swing gear is decoupled from said second gear means.

8. A sheet feed device according to claim 7, further comprising an idler gear interposed between said second swing gear and said second roller means.

9. A sheet feed device according to claim 8, wherein said first roller means comprises a single roller rotatable about its own axis extending in a transverse direction of the sheet-like material.

10. A sheet feed device according to claim 9, wherein said motor, said motor gear, said speed reduction gear assembly, said power transmitting mechanism, said single roller and said main and auxiliary feed rollers are housed in a common and single unit.

11. A sheet feed device according to claim 9 further comprising an apparatus for recording data on sheet-like material feed to said apparatus by said sheet feed device.

12. A sheet feed device according to claim 11, wherein said second roller means further comprises a feed roller for further feeding the sheet-like material fed by said main and auxiliary feed rollers.

13. A sheet feed device according to claim 12, wherein the sheet-like material is a sheet of paper having a predetermined length in the sheet feeding direction.

14. A sheet feed device for feeding a sheet-like material in a sheet feeding direction, comprising:

a main feed roller rotatable about its own axis extending in a direction which is transverse to the sheet-like material to be fed, said main feed roller having a main feed roller gear secured to the axis of said main feed roller;

an auxiliary feed roller rotatable about its own axis extending in parallel to the axis of said main feed roller, said main and auxiliary feed rollers cooperating with each other to frictionally feed the sheet-like material in the sheet feeding direction, said auxiliary feed roller having an auxiliary feed roller gear secured to the axis of said auxiliary feed roller;

a motor for rotating said main roller at a given rotational speed;

a clutch mechanism, operatively connected to said main feed roller and said auxiliary roller, for transmitting the rotation of said main feed roller to said auxiliary feed roller when said auxiliary feed roller rotates at a rotational speed slower than a predetermined speed and for cutting the transmission of the rotation of said main feed roller to said auxiliary feed roller when said auxiliary feed roller rotates at a rotational speed faster than the predetermined speed.

15. A sheet feed device according to claim 14, wherein said clutch mechanism comprises a drive gear rotatable about its own axis, said drive gear being held in mesh with said main feed roller gear, a swing lever swingably mounted on the axis of said drive gear to be slippingly rotatable with the axis thereof, said swing lever having a distal end, a clutch gear rotatably mounted on the distal end of said swing lever, said clutch gear being held in mesh with said drive gear and being adapted to be meshingly engageable with said auxiliary feed roller gear.

16. A sheet feed device according to claim 15, wherein said clutch gear is brought to meshing engagement with said auxiliary feed roller gear when said auxiliary feed roller is rotating at the rotational speed slower than a rotational speed of said clutch gear, and wherein said clutch gear is held in disengagement with said auxiliary feed roller gear when said auxiliary feed roller is rotating at the rotational speed faster than the rotational speed of said clutch gear.

* * * * *